US005728221A

United States Patent [19]

Kang

[11] Patent Number: 5,728,221

[45] Date of Patent: Mar. 17, 1998

[54] APPARATUS FOR FORMING FLUORESCENT LAYER FOR BLACK-AND-WHITE CRT

[75] Inventor: Seoug Wan Kang, Kyungsangbuk-do, Rep. of Korea

[73] Assignee: LG Electronics Inc., Seoul, Rep. of Korea

[21] Appl. No.: 504,660

[22] Filed: Jul. 20, 1995

[30] Foreign Application Priority Data

Jul. 21, 1994 [KR] Rep. of Korea ..... 17693/1994

[51] Int. Cl.[6] ..... B05C 13/00

[52] U.S. Cl. ..... 118/500; 118/503; 118/52; 427/64; 427/71; 427/72; 427/240

[58] Field of Search ..... 118/52, 54, 500, 118/503; 269/908; 427/64, 71, 72, 240

[56] References Cited

U.S. PATENT DOCUMENTS 4,312,292 1/1982 Smith et al. ..... 118/503
5,316,785 5/1994 Yanai et al. .

FOREIGN PATENT DOCUMENTS 2435629 2/1976 Germany .

*Primary Examiner*—Laura Edwards
*Attorney, Agent, or Firm*—Fish & Richardson P.C.

[57] ABSTRACT

A method and apparatus for forming a fluorescent layer for a black-and-white CRT is disclosed including: a first rotation shaft installed perpendicular to the horizontal plane; a rotation table fixed to the first rotation shaft and integrally formed with a sloped portion, the table being rotated along with the first rotation shaft; a second rotation shaft installed perpendicular to the sloped surface of the sloped portion; and a deposition table fixed to the second rotation shaft and in which a bulb can be mounted.

4 Claims, 2 Drawing Sheets

APPARATUS FOR FORMING FLUORESCENT LAYER FOR BLACK-AND-WHITE CRT

BACKGROUND OF THE INVENTION

The present invention relates to a method and apparatus for forming a fluorescent layer on the screen of a black-and-white CRT, and more particularly, to a method and apparatus for forming a fluorescent layer using a rotation table.

FIG. 1 is a schematic sectional view of explaining one example of a conventional method for forming a fluorescent layer. In FIG. 1, a bulb B is mounted on a fixed block 2 of a fixed deposition table 1. Suspension L containing phosphor particles is injected into the bulb. In this situation, the phosphor particles contained in the suspension are deposited onto the bottom, that is, screen surface Ba, of bulb B.

This method can be employed in case that screen surface Ba is, however, planar or convex, not concave, with the outer surface of the screen being taken as the reference.

Where the screen surface Ba of bulb B is planar or convex, the phosphor contained in suspension L of bulb B by a predetermined height is deposited uniformly. However, if the screen surface Ba of bulb B is concave, the thickness of the phosphor deposited varies because the height of suspension L filled in bulb B from the liquid surface to screen surface Ba is different on the center and on the periphery. This produces color spots on screen surface Ba, thereby deteriorating color uniformity during operation.

A method for uniformly coating the phosphor where the screen surface is concave was disclosed in Korean Patent publication No. 92-7002. Referring to FIG. 2, deposition table 3 on which bulb B is mounted is rotated by a rotation means at a predetermined number of rotation. At the same time, deposition table 3 is displaced within 0°–30° by a cam (not shown) driven by a driving means.

The rotation of deposition table 3 is gradually accelerated to reach a normal speed after a predetermined time. Here, the normal rotation speed of deposition table 3 is 0–300 rpm so that suspension L of bulb B becomes a static flow.

In this method, when the phosphor particles contained in suspension L injected in bulb B are deposited, they settle down on screen surface Ba of bulb B obliquely in the static flow by the vertical sedimentation speed component, horizontal sedimentation speed component and a sedimentation force in which the vertical and horizontal sedimentation speed components are combined. When the fluorescent layer is completed with the phosphor particles being deposited on screen surface Ba, suspension L is discharged from bulb B.

According to this method, the thickness of screen surface Ba on the center and periphery is improved by the centrifugal force. However, this does not affect the sedimentation force over screen surface Ba at all. As a result, the layer coating characteristic becomes poor, involving luminance non-uniformity. In addition, the sedimentation time (about 20 minutes) is not shortened.

SUMMARY OF THE INVENTION

Therefore, in order to overcome such drawbacks, it is an object of the present invention to provide a method and apparatus for forming a fluorescent layer for a black-and-white CRT in which the fluorescent layer is formed on the screen with the bulb rotating and revolving, thereby enhancing the overall luminance and sharply shortening the sedimentation force because the layer coating characteristic is improved.

To accomplish the object of the present invention, there is provided a method of forming a fluorescent layer for a black-and-white CRT wherein suspension containing phosphor particles is injected into a bulb and deposited, and wherein the bulb is installed obliquely against the horizontal plane, the bulb rotating and revolving while the suspension is deposited.

For the object of the present invention, there is further provided an apparatus of forming a fluorescent layer for a black-and-white CRT comprising: a first rotation shaft installed perpendicular to the horizontal plane; a rotation table fixed to the first rotation shaft and integrally formed with a sloped portion, the table being rotated along with the first rotation shaft; a second rotation shaft installed perpendicular to the sloped surface of the sloped portion; and a deposition table fixed to the second rotation shaft and in which a bulb is mounted.

BRIEF DESCRIPTION OF THE ATTACHED DRAWINGS

DETAILED DESCRIPTION OF THE INVENTION

Figure 1:
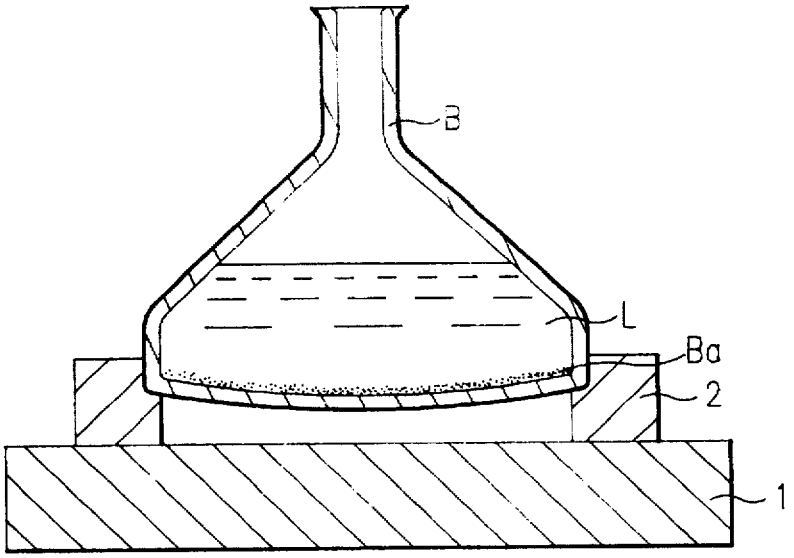
F I G.1 prior art
FIG. 1 is a schematic sectional view of one example of a conventional method for forming a fluorescent layer.
Figure 2:
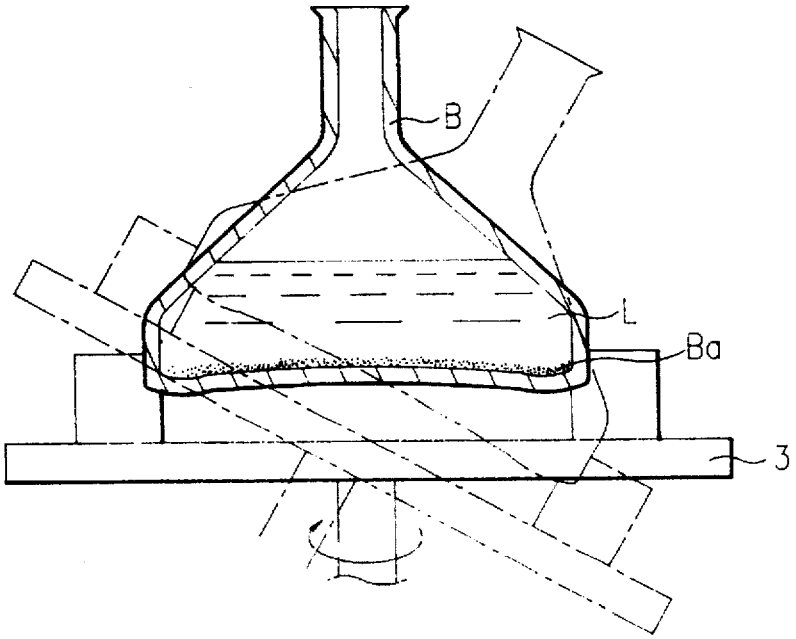
F I G.2 prior art
FIG. 2 is a schematic sectional view of another example of the conventional method for forming a fluorescent layer.
Figure 3:
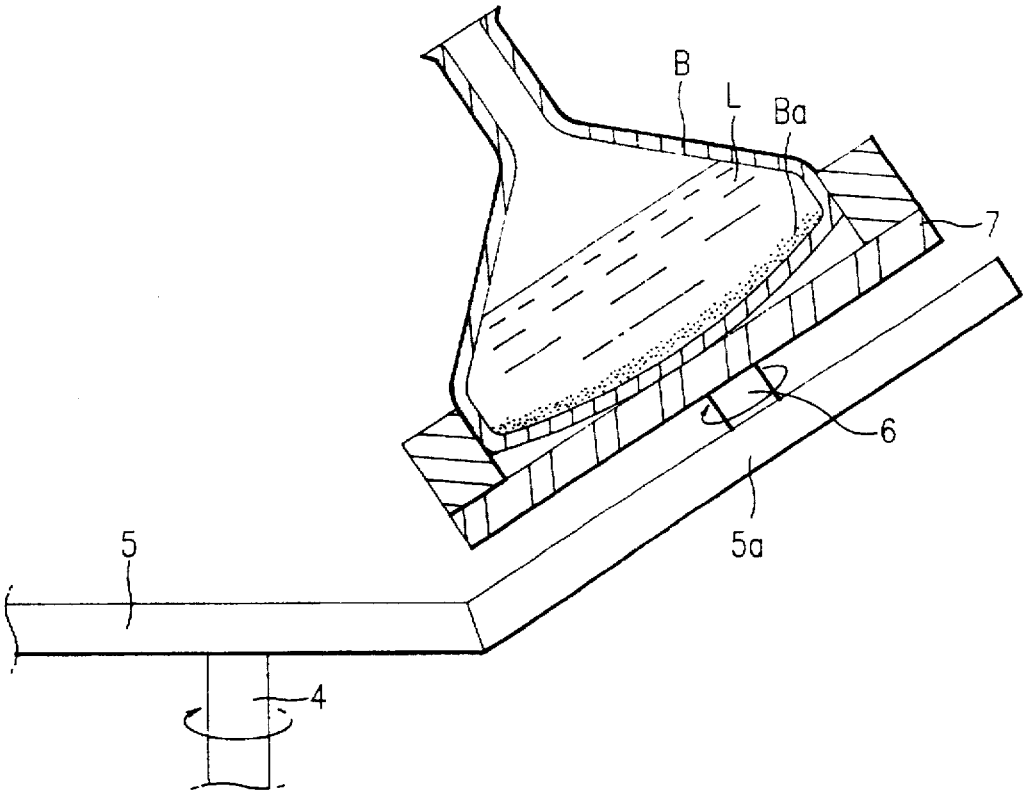
FIG. 3 is a schematic sectional view of one embodiment of the present invention.

One preferred embodiment of the present invention will be described with reference to FIGS. 3, 4 and 5.

A first rotation shaft 4 is installed perpendicularly from the horizontal plane. A rotation table 5 is fixed at the center of the rotation shaft. A sloped portion 5*a* is formed on one side thereof. A second rotation shaft 6 is fixed on the sloped portion perpendicular thereto. A deposition table 7 and bulb B are mounted on the second rotation shaft. The angle of sloped portion 5*a* is preferably greater than 0° and smaller than 80°.

A method of forming a black-and-white CRT using the above-mentioned apparatus of the present invention will be described below. First, bulb B is washed using fluoric acid and pure water, and mounted on deposition table 7. Thereafter, an electrolyte, which is a barium nitrate aqueous solution, and suspension L containing phosphor particles are injected sequentially.

In order to provide a centrifugal force onto the panel, first rotation shaft 4 is gradually accelerated upto 300 rpm, and second rotation shaft 6 is gradually accelerated upto 200 rpm. By doing so, bulb B is rotated and revolved centering on first and second rotation shafts 4 and 6. The rotation and revolution of the bulb is performed continuously for 30 seconds-3 minutes.

According to this operation, the phosphor particles contained in suspension L are deposited over the panel by the composite external force. Specifically, the centrifugal force toward the overall surface of the panel, the centrifugal force toward the periphery thereof and the sedimentation force created due to the gravity work compositely onto the phosphor particles.

Figure 4:
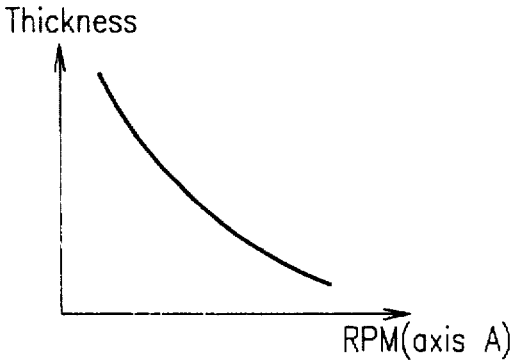
FIG. 4 is a graph of showing the relationship between the first rotation shaft and layer thickness.
Figure 5:
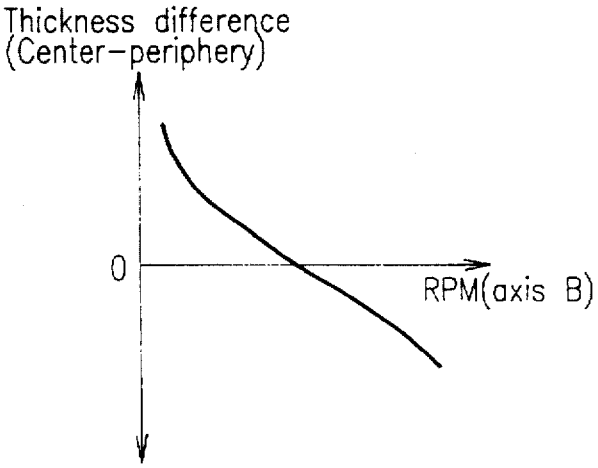
FIG. 5 is a graph of showing the second rotation shaft and layer thickness.

When the rotation number of first rotation shaft 4 is increased, the thickness of the layer gradually decreases, as shown in FIG. 4. When the rotation number of second rotation shaft 6 becomes above 200 rpm, the thickness difference between the center and periphery is produced, as shown in FIG. 5. This will be clarified in the following table.

| second rotation shaft | 50 | 100 | 150 | 200 | 250 | 300 | 350 | simple sedimentation |
|---|---|---|---|---|---|---|---|---|
| thickness | 13.7 | 13.2 | 10.3 | 9.1 | 9.0 | 8.9 | 8.9 | 15 |

As described above, in the present invention the fluorescent layer is coated with the bulb rotating and revolving, improving the layer coating characteristic and eliminating the thickness difference on the center and periphery. This prevents poor luminance and sharply shortens the deposition time.

What is claimed is:

1. An apparatus for forming a fluorescent layer for a CRT comprising:

a first rotation shaft installed perpendicular to a horizontal plane;

a rotation table fixed to said first rotation shaft and integrally formed with a sloped portion, said table being rotated along with said first rotation shaft;

a second rotation shaft installed perpendicular to the sloped surface of said sloped portion; and a deposition table for holding a bulb fixed to said second rotation shaft such that said deposition table revolves around said second shaft.

2. An apparatus of forming a fluorescent layer for a CRT as claimed in claim 1, wherein the angle of said sloped portion is greater than 0° and smaller than 80° with respect to the horizontal plane.

3. An apparatus for use in forming a fluorescent layer on a surface of CRT comprising:

a deposition table holding a bulb, which table is in a first plane that is at an angle with respect to a horizontal plane; and which table is (i) rotatable about a first axis perpendicular to the first plane; and (ii) revolvable around a second axis perpendicular to the horizontal plane such that both the table and bulb can be simultaneously rotated and revolved in forming a fluorescent layer therein.

4. The apparatus of claim 3 further comprising a first shaft along the first axis, a second shaft along the second axis and drivers for the first shaft and the second shaft providing a rotation speed for the table that is equal to or less than a revolution speed for the table.

* * * * *